US008974268B2

(12) United States Patent
Darcangelo et al.

(10) Patent No.: US 8,974,268 B2
(45) Date of Patent: Mar. 10, 2015

(54) METHOD OF PREPARING AN EDGE-STRENGTHENED ARTICLE

(75) Inventors: Charles Michael Darcangelo, Corning, NY (US); Steven Edward DeMartino, Painted Post, NY (US); Joseph Fabian Ellison, Penfield, NY (US); Richard A Nasca, Rochester, NY (US); Aric Bruce Shorey, Painted Post, NY (US); David Alan Tammaro, Painted Post, NY (US); John Christopher Thomas, Elmira, NY (US)

(73) Assignee: Corning Incorporated, Corning, NY (US)

( * ) Notice: Subject to any disclaimer, the term of this patent is extended or adjusted under 35 U.S.C. 154(b) by 382 days.

(21) Appl. No.: 13/112,498

(22) Filed: May 20, 2011

(65) Prior Publication Data

US 2011/0318994 A1 Dec. 29, 2011

Related U.S. Application Data

(60) Provisional application No. 61/358,611, filed on Jun. 25, 2010.

(51) Int. Cl.
*B24B 1/00* (2006.01)
*B24B 9/06* (2006.01)

(52) U.S. Cl.
CPC ..... *B24B 1/005* (2013.01); *B24B 9/065* (2013.01)
USPC ..... 451/44; 451/36; 451/37; 451/41

(58) Field of Classification Search
CPC ..... B24B 1/005; B24B 9/00
USPC ..... 451/36, 113, 43, 37, 296, 446, 106, 74
See application file for complete search history.

(56) References Cited

U.S. PATENT DOCUMENTS

| | | | | | |
|---|---|---|---|---|---|
| 3,843,472 | A * | 10/1974 | Toussaint et al. | 428/192 |
| 4,911,743 | A * | 3/1990 | Bagby | 65/31 |
| 5,128,281 | A * | 7/1992 | Dyer et al. | 438/693 |
| 5,578,238 | A * | 11/1996 | Weiss et al. | 252/62.52 |
| 5,616,066 | A * | 4/1997 | Jacobs et al. | 451/36 |
| 5,674,790 | A * | 10/1997 | Araujo | 501/66 |
| 5,795,212 | A * | 8/1998 | Jacobs et al. | 451/36 |
| 6,106,380 | A | 8/2000 | Jacobs et al. | 451/360 |
| 6,325,704 | B1 * | 12/2001 | Brown et al. | 451/44 |
| 6,402,978 | B1 * | 6/2002 | Levin | 252/62.52 |
| 6,761,747 | B2 * | 7/2004 | Gottfried et al. | 51/309 |
| 6,921,455 | B1 * | 7/2005 | Nakano et al. | 156/345.11 |

(Continued)

FOREIGN PATENT DOCUMENTS

WO WO 9404313 A1 * 3/1994 ..... B24B 39/02

OTHER PUBLICATIONS

J. DeGroote et al., "Removal rate model for magnetorheological finishing of glass", *Applied Optics*, 46(32): 7927-7941.

(Continued)

*Primary Examiner* — Lee D Wilson
*Assistant Examiner* — Tyrone V Hall, Jr.
(74) *Attorney, Agent, or Firm* — Jason A. Barron

(57) ABSTRACT

A method of preparing an edge-strengthened article comprises polishing of an edge of an article having a first edge strength using magnetorheological finishing, wherein after the polishing the article has a second edge strength and the second edge strength is greater than the first edge strength.

18 Claims, 2 Drawing Sheets

(56) References Cited

U.S. PATENT DOCUMENTS

| | | | | |
|---|---|---|---|---|
| 6,991,521 | B2 | 1/2006 | Hagan et al. | 451/44 |
| 7,217,662 | B2 * | 5/2007 | Toyota et al. | 438/690 |
| 2002/0042244 | A1 * | 4/2002 | Trommer | 451/41 |
| 2002/0081943 | A1 * | 6/2002 | Hendron et al. | 451/8 |
| 2006/0216552 | A1 * | 9/2006 | Ikenishi et al. | 428/846.9 |

OTHER PUBLICATIONS

M. Fox et al., "Magnetic abrasive finishing of rollers", Ann. CIRP 43 (1994).

Genc et al., "Rheological Properties of Magnetorheological Fluids", Smart Materials and Structures, 11:140-146 (2002).

Jacobs et al., "Magnetorheogical Finishing of IR Materials", Proceedings SPIE 3334:258-269 (1997).

Jang et al., "Role of organic coating on carbonyl iron suspended particles in magnetorheological fluids", *Jnl of Appled Physics*: 97(10Q912) (2005).

Khairy, Ahmed B.1, "Aspects of surface and edge finish by magnetoabrasive particles", Journal of Materials Processing Technology, v 116, n 1, p. 77-83, Oct. 3, 2001.

Kittipoomwong et al., "Dynamic yield stress enhancement in bidisperse magnetorheological fluids" *J. Rheology*, 49(6) (2005).

Kobayashi et al. "Precision Treatment of Silicon Wafer Edge Utilizing Ultrasonically Assisted Polishing Technique", *Journal of Materials Processing Technology*, 201:531-535 (2008).

Kozhinova et al., Minimizing artifact formation in magnetorheological finishing of chemical vapor deposition ZnS flats, Applied Optics, 44(22): 4671-4677.

Lambropoulos et al., "Manufacturing-induced residual stresses in optical glasses and crystals: Example of residual stress relief by magnetorheological finishing (MRF) in commercial silicon wafers", Proceedings SPIE, 4451: 181-190 (2001).

Pu et al., "Studies on preparation and chemical stability of reduced iron particles encapsulated with polysiloxane nano-films", *Materials Letters* 60:94-97 (2006).

Randi et al., "Subsurface damage in some single crystalline optical materials", Applied Optics, 44(12):2241-2249 (2005).

Shafrir et al., "Zirconia-coated carbonyl-iron-particle-based magnetorheological fluid for polishing optical glasses and ceramics", Applied Optics, 48(35):6797-6810.

Shen et al., "Synthesis and corrosion study of zirconia-coated coarbonyl iron particles", Jnl of Colloid and Interface Science, 342:49-56 (2010).

Shorey et al., "Magnetorheological finishing of large and lightweight optics", Proceedings SPIE, 5533: 99-107 (2004).

A.B. Shorey, "Mechanisms of Material Removal in Magnetorheological Finishing (MRF) of Glass", PhD Dissertation, University of Rochester, May 2000.

Cheng, Hai Bin et al., Preparation of composite magnetic particles and aqueous magnetorheological fluids, *Smart Materials and Structures*, IOP Publishing, Ltd., Bristol, GB, vol. 18, No. 8, Aug. 1, 2009, pp. 1-6.

Kordonski, W.I., et al., Fundamentals of Magnetorhelogical Fluid Utilization in High Precision Finishing, *Journal of intelligent Material Systems and Structures*, Technomic Publishing, Lancaster, PA US., vol. 10, No. 9, Sep. 1, 1999, pp. 683-689.

International Search Report and Written Opinion dated Sep. 29, 2011 pertaining to International Application PCT/US2001/041586, International Filing Date Jun. 23, 2011.

* cited by examiner

METHOD OF PREPARING AN EDGE-STRENGTHENED ARTICLE

This application claims the benefit of priority under 35 U.S.C. §119 of U.S. Provisional Application Ser. No. 61/358,611 filed on Jun. 25, 2010 the content of which is relied upon and incorporated herein by reference in its entirety.

BACKGROUND

1. Field

Embodiments relate generally to a method for finishing and strengthening edges of articles made of brittle materials.

2. Technical Background

Mechanical separation is an example of a method for cutting a glass sheet. Mechanical separation typically involves mechanically scoring a glass sheet to form a score line in the glass sheet and subsequently breaking the glass sheet along the score line. The mechanical scoring and breaking result in a glass sheet with a rough/sharp edge, which are are undesirable and makes the glass sheet vulnerable to cracking. Material can be removed from the rough/sharp edge in order to smoothen/dull the edge and reduce the glass sheet's vulnerability to cracking. Abrasive grinding can be used to mechanically remove material from the rough/sharp edge of the glass sheet. Abrasive grinding involves use of a metal grinding tool with micron-sized abrasive particles which may or may not be fixed on the tool to remove material. The mechanism of material removal using abrasive grinding is considered to involve fracturing. As a result, fracture sites can appear on the edge after grinding. The larger the abrasive particles used in the grinding, the larger the fracture sites that can appear on the edge after grinding. These fracture sites effectively become stress concentrations and fracture initiation sites, which result in a finished glass sheet having a lower edge strength than the initial glass sheet. Grinding tools with smaller abrasive particles and/or mechanical polishing tools can be used to reduce the size of the fracture sites. Mechanical polishing tools can be metal or polymer wheels. Mechanical polishing also involves use of abrasive particles, but the abrasive particles are not fixed on the polishing tool. A rough edge may be avoided by cutting the glass sheet by laser separation. However, a glass sheet that is cut by laser separation is typically not exempt from a sharp edge. Laser scoring produces sharp edges and corners that are highly susceptible to impact damage, therefore it is desirable to further shape finish laser scored edges. Typically, a polishing wheel made of a series of hard bound abrasives and/or a lap with loose slurry may be used to remove the sharp laser scored edge, e.g., by beveling or rounding the edge. Several polishing steps are typically needed to remove the sharp edge, which can significantly increase the cost of the finished glass sheet.

SUMMARY

One embodiment is a method of preparing an edge-strengthened article comprising polishing an edge of an article having a first edge strength using magnetorheological finishing, wherein after the polishing the article has a second edge strength and the second edge strength is greater than the first edge strength.

Another embodiment is a magnetorheological polishing fluid comprising a liquid vehicle comprising an etching agent having a pH≤5, magnetizable particles suspended in the liquid vehicle, and abrasive particles suspended in the liquid vehicle.

Another embodiment is a magnetorheological polishing fluid comprising a liquid vehicle comprising an etching agent having a pH≥10, magnetizable particles suspended in the liquid vehicle, and abrasive particles suspended in the liquid vehicle.

Additional features and advantages of the invention will be set forth in the detailed description which follows, and in part will be readily apparent to those skilled in the art from the description or recognized by practicing the invention as described in the written description and claims hereof, as well as the appended drawings.

It is to be understood that both the foregoing general description and the following detailed description are merely exemplary of the invention, and are intended to provide an overview or framework for understanding the nature and character of the invention as it is claimed.

The accompanying drawings are included to provide a further understanding of the invention, and are incorporated in and constitute a part of this specification. The drawings illustrate one or more embodiment(s) of the invention and together with the description serve to explain the principles and operation of the invention.

BRIEF DESCRIPTION OF DRAWINGS

The invention can be understood from the following detailed description either alone or together with the accompanying drawing figures.

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
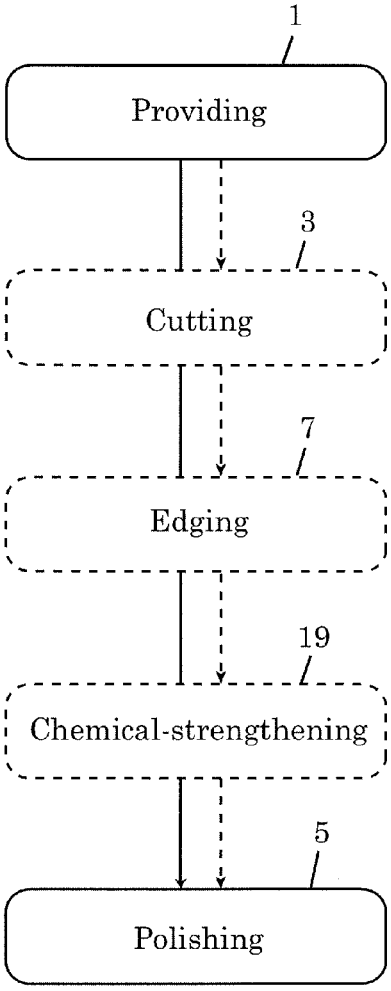
FIG. 1 is a flowchart illustrating a method of preparing an edge-strengthened article.

In the following detailed description, numerous specific details may be set forth in order to provide a thorough understanding of embodiments of the invention. However, it will be clear to one skilled in the art when embodiments of the invention may be practiced without some or all of these specific details. In other instances, well-known features or processes may not be described in detail so as not to unnecessarily obscure the invention. In addition, like or identical reference numerals may be used to identify common or similar elements.

FIG. 1 is a flowchart illustrating a method of preparing edge-strengthened articles according to one embodiment. The articles to be prepared by the method are made of brittle materials. Examples of brittle materials include glasses, glass-ceramics, ceramics, silicon, semiconductor materials, and combinations of the preceding materials. In one embodiment, the method includes a polishing process 5, which includes polishing of the edge of an article using magnetorheological finishing (MRF). In the interest of clarity, the polishing process 5 will be described as being applied to a single article. However, a plurality of articles can be simultaneously processed during a polishing process 5 by, for example, ganging the articles and polishing the articles as a single article would be polished. Herein, the term "edge" of an article refers to the circumferential edge or perimeter (the article can be of any shape and is not necessarily circular) of the article. The edge may include one of or any combination of straight edge portions, curved edge portions, beveled edge portions, rough edge portions, and sharp edge portions. Polishing of the edge of the article may include polishing of a portion of the edge or polishing of the entire edge of the article. The article has a first edge strength at the beginning of the polishing process 5 and a second edge strength at the end of the polishing process 5. In one or more embodiments, the second edge strength at the end of the polishing process 5 is much greater than the first edge strength at the beginning of the polishing process 5. For example, second edge strength of up to 5 times the first edge strength has been observed. This observation is not intended to limit the invention. Second edge strength greater than 5 times the first edge strength may also be possible. This indicates that the MRF used in the polishing process 5 has the salubrious effect of strengthening while polishing the article. The examples below will show that improvement in edge strength is possible regardless of the condition of the article at the beginning of the polishing process.

During the polishing process 5, MRF removes damage from the surface being polished without imparting new damage to the surface—this is in contrast to mechanical processes that involve use of mechanical tools such as pads, wheels, and belts to apply abrasives to a surface for the purpose of removing material from the surface. MRF uses a fluid-based conformable tool, called a magnetorheological polishing fluid (MPF), for polishing. MPF can include micron-sized magnetizable particles and micron-sized to nano-sized abrasive particles suspended in a liquid vehicle. For example, the sizes of the magnetizable particles may be in a range from 1 μm to 100 μm or greater, for example, 1 μm to 150 μm, for example, 5 μm to 150 μm, for example, 5 μm to 100 μm, for example, 5 μm to 50 μm, for example, 5 μm to 25 μm, for example, 10 μm to 25 μm and the sizes of the abrasive particles may be in a range from 15 nm to 10 μm. The magnetizable particles may have a uniform or a non-uniform particle size distribution, the same or different shapes, and regular or irregular shapes. Also, the magnetizable particles may be made of a single magnetizable material or a combination of different magnetizable materials. Examples of magnetizable materials include iron, iron oxide, iron nitride, iron carbide, carbonyl iron, chromium dioxide, low-carbon steel, silicon steel, nickel, cobalt, and a combination of the preceding materials. The magnetizable particles may also be coated or encapsulated, for example, with or in a protective material. In one embodiment, the protective material is a material that is chemically and physically stable in the liquid vehicle and that does not react chemically with the magnetizable material. Examples of suitable protective materials include zirconia, alumina, and silica. Similarly, the abrasive particles may have a uniform or a non-uniform particle size distribution, the same or different shapes, and regular or irregular shapes. Also, the abrasive particles may be made of a single non-magnetizable material or a combination of different non-magnetizable materials. Examples of abrasive materials include cerium oxide, diamond, silicon carbide, alumina, zirconia, and a combination of the preceding materials. Other abrasive materials not specifically included in this list and known to be useful in polishing a surface may also be used. The liquid vehicle included in a MPF may be aqueous or non-aqueous. Examples of vehicles include mineral oil, synthetic oil, water, and ethylene glycol. The vehicles may further include stabilizers, e.g., stabilizers to inhibit corrosion of the magnetizable particles, and surfactants.

In another embodiment, a MPF that can etch while polishing is provided. The etching MPF includes magnetizable particles and abrasive particles suspended in a liquid vehicle including an etching agent. The etching agent is one that is capable of etching the material of the article and would be selected based on the material of the article. The liquid vehicle may further include a solvent for the etching agent. The liquid vehicle may further include stabilizers and surfactants. The liquid vehicle may be aqueous or non-aqueous, as described above. The magnetizable particles and abrasive particles are as described above for the non-etching MPF. The magnetizable particles may be coated or encapsulated, for example, with or in a protective material, as described above. The protective material, when used, is a material that is chemically and physically stable in the presence of the etching agent and other materials in the liquid vehicle. The protective material is also a material that does not react with the magnetizable particles. Suitable examples of protective materials are zirconia and silica.

In one embodiment, the etching agent included in the etching MPF has a pH less than or equal to 5. In one embodiment, the etching agent that has a pH less than or equal to 5 comprises an acid. In one embodiment, the etching agent is an acid. The acid may exist in liquid form or may be dissolved in a suitable solvent. Examples of suitable acids include, but are not limited to, hydrofluoric acid and sulfuric acid. The liquid vehicle may further include one or more stabilizers, e.g., a stabilizer to inhibit corrosion of the magnetizable particles. Stabilizers used in the liquid vehicle should be stable in the presence of the acid or, more generally, in the presence of the etching agent.

In another embodiment, the etching agent included in the etching MPF has a pH greater than or equal to 10. In one embodiment, the etching agent that has a pH greater than or equal to 10 comprised an alkali salt. In one embodiment, the etching agent is an alkali salt. Examples of such alkali salts include, but are not limited to, alkali hydroxides, e.g., potassium hydroxide, sodium hydroxide, and compounds containing alkali hydroxides. A detergent containing an alkali hydroxide may be used as the alkali salt in the liquid vehicle, for example. The liquid vehicle may include other materials besides alkali salts, such as surfactants and other materials that may be found in detergents.

Figure 2:
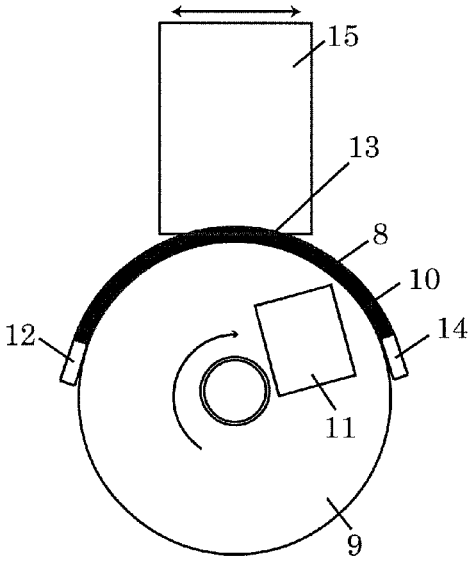
FIG. 2 is a schematic illustration of a method of polishing an edge of an article using magnetorheological finishing.

MPF is deposited on a support surface in the form of a ribbon. Typically, the support surface is a moving surface, but the support surface may also be a fixed surface. The support surface may have a variety of shapes, e.g., spherical, cylindrical, or flat. For illustration purposes, FIG. 2 shows an end view of a MPF ribbon 8 on a rotating wheel 9. In this case, the circumferential surface 10 of the rotating wheel 9 provides a moving cylindrical support surface for the MPF ribbon 8. A nozzle 12 is used to deliver the MPF ribbon 8 to one end of the surface 10, and a nozzle 14 is used to collect the MPF ribbon 8 from another end of the surface 10. During the MRF, a magnet 11 applies a magnetic field to the MPF ribbon 8. The applied magnetic field induces polarization on the magnetizable particles, causing the magnetizable particles to form chains or columnar structures that restrict flow. This increases the apparent viscosity of the MPF ribbon 8, changing the MPF ribbon 8 from a liquid state to a solid-like state. The edge 13 of an article 15 is polished by contacting the edge 13 with the stiffened MPF ribbon 8 and reciprocating the edge 13 relative to the stiffened MPF ribbon 8—the relative motion between the edge 13 and the MPF ribbon 8 is such that all the portions of the edge 13 to be polished make contact with the stiffened MPF ribbon 8 at some point during the polishing. In one embodiment, the edge 13 of an article 15 is polished by immersing the edge 13 into the stiffened MPF ribbon 8. Although the polishing process (5 in FIG. 1) has been described in terms of polishing a single article using MRF, it should be noted that multiple articles may be polished simultaneously in a single polishing process. Also, a polishing process (5 in FIG. 1) may comprise a plurality of MRF steps. Where multiple MRF steps are used in a single polishing process, the parameters of the MRF steps may be tailored and varied such that the MRF steps in combination achieve a goal more effectively than a single MRF step would. In one embodiment, the article 15 is movable, for example, the article can spin about a center axis relative to the article; the article can be moved vertically or horizontally with respect to the rotating wheel 9; the article can be tilted at an angle from perpendicular with respect to the rotating wheel, for example, wherein the edge of the article being polished and in contact with the MPF is at an angle of 90 degrees or less from the rotating wheel. The article can be tilted to either side off perpendicular.

MRF removes material from the surface being polished by shearing. This is in contrast to the fracturing mechanism associated with mechanical processes such as mechanical grinding. With this mechanism, MRF has an opportunity to remove material from the edge without inducing new fracture sites in the edge that could lower the strength of the edge. Simultaneously, MRF removes defects from the edge that results in an increase in the strength of the edge, i.e., from the first edge strength to the second edge strength. Moreover, the MPF ribbon 8, which is fluid-based, has the ability to conform to the shape of the edge, no matter the complexity, e.g., in terms of curvature or profile, of the edge, which leads to complete, high-quality polishing of the edge. MRF is governed by several parameters, e.g., the viscosity of the MPF, the rate at which the MPF is delivered to the moving surface, the speed of the moving surface, the intensity of the magnetic field, the height of the MPF ribbon, the depth to which the edge is immersed into the MPF ribbon, and the rate at which material is removed from the edge.

Returning to FIG. 1, the polishing process 5 is preceded by a providing step 1 in which the article to be edge-strengthened is provided. The article provided in the providing step 1 is made of a brittle material, as described above. The article may be a planar (two-dimensional) article or a shaped (three-dimensional) article. The article may be provided in the providing step 1 with an initial edge strength. The article may be provided in the providing step 1 with an initial edge shape. The first edge strength may be the same as the initial edge strength if there are no intervening processes between the providing step 1 and the polishing step 5. On the other hand, if there are intervening processes between the providing step 1 and the polishing process 5, the first edge strength may be different from the initial edge strength. For example, processes such as cutting, machining, and ion-exchange may result in the first edge strength being different from the initial edge strength.

FIG. 1 shows that a cutting process 3 may be implemented between the providing step 1 and the polishing process 5. Cutting may be by any of a number of processes suitable for the task, e.g., mechanical separation, laser separation, or ultrasonic separation. In mechanical separation, the article is scored mechanically, e.g., using a scoring wheel, water jets, or abrasive water jets. Then, the article is separated along the score line(s). In laser separation a mechanical flaw is made near an edge, then thermally run across the article using a laser line source then separated using a stress gradient induced usually by a water spray. There may be a single article or a plurality of articles after the cutting step 3. In the latter case, one or all of the plurality of articles may be processed in the polishing process 5 and any intervening processes between the cutting step 3 and the polishing process 5. Each article will arrive at the polishing process 5 with a first edge strength to be boosted to a second edge strength.

FIG. 1 also shows that an edging process 7 may be implemented between the providing step 1 and the polishing process 5. In the edging process 7, the shape and/or texture of the edge of the article is modified by removing material from the edge. Any of a number of processes may be employed in the edging process 7. Examples include, but are not limited to, abrasive machining, abrasive jet machining, chemical etching, ultrasonic polishing, ultrasonic grinding, chemical-mechanical polishing. The edging process 7 may include a single material removal process or a series or combination of material removal processes. For example, an edging process 7 may include a series of grinding steps, where the grinding parameters, such as the grit size of the grinding material, are altered for each step in the series to achieve a different edging result at the end of each step. Abrasive machining will be described in more detail below since abrasive machining processes are used in the examples that will be presented below.

Abrasive machining may involve one or more and any combination of mechanical grinding, lapping, and polishing. These processes are mechanical in the sense that they involve contact between a solid tool and the surface being processed. Each of the grinding, lapping, and polishing may be accomplished in one or more steps. Grinding is a fixed-abrasive process, while lapping and polishing are loose-abrasive processes. Grinding may be accomplished using abrasive particles embedded in a metal or polymer bonded to a metal wheel. Alternatively, grinding may be accomplished using an expendable wheel made of an abrasive compound. In lapping, abrasive particles, typically suspended in a liquid medium, are disposed between a lap and an edge of an article. Relative motion between the lap and the edge of the article abrades material from the edge. In polishing, abrasive particles, typically suspended in a liquid medium, are applied to an edge of an article using a conformable soft pad or wheel. The conformable soft pad or wheel may be made of a polymeric material, e.g., butyl rubber, silicone, polyurethane, and natural rubber. Abrasives used in abrasive machining may be selected from, for example, alumina, silicon carbide, diamond, cubic boron nitride, and pumice.

FIG. 1 also shows that a chemical-strengthening process 19 may be implemented between the providing step 1 and the polishing process 5. In lieu of implementing the chemical-strengthening process between the providing step 1 and the polishing process 5, the article may be provided in the providing step 1 as a chemically-strengthened article. In one embodiment, the chemical-strengthening process is an ion-exchange process. In order to implement the ion-exchange process, the article provided in the providing step 1 must be made of an ion-exchangeable material. Typically, ion-exchangeable materials are alkali-containing glasses with smaller alkali ions, such as $Li^+$ and/or $Na^+$, that can be exchanged for larger alkali ions, e.g., K+, during an ion-exchange process. Examples of suitable ion-exchangeable glasses are described in U.S. patent application Ser. Nos. 11/888,213, 12/277,573, 12/392,577, 12/393,241, and 12/537,393, U.S. Provisional Application Nos. 61/235,767 and 61/235,762 (all assigned to Corning Incorporated), the contents of which are incorporated herein by reference. These glasses can be ion-exchanged at relatively low temperatures and to a depth of at least 30 μm.

An ion-exchange process is described in, for example, U.S. Pat. No. 5,674,790 (Araujo, Roger J.). The process typically occurs at an elevated temperature range that does not exceed the transition temperature of the glass. The process is carried out by immersing the glass in a molten bath comprising an alkali salt (typically a nitrate) with ions that are larger than that of the host alkali ions in the glass. The host alkali ions are exchanged for the larger alkali ions. For example, a glass containing $Na^+$ may be immersed in a bath of molten potassium nitrate ($KNO_3$). The larger $K^+$ present in the molten bath will replace the smaller $Na^+$ in the glass. The presence of the larger alkali ions at sites formerly occupied by small alkali ions creates a compressive stress at or near the surface of the glass and tension in the interior of the glass. The glass is removed from the molten bath and cooled down after the ion-exchange process. The ion-exchange depth, i.e., the penetration depth of the invading larger alkali ions into the glass, is typically on the order of 20 μm to 300 μm, for example, 40 μm to 300 μm and is controlled by the glass composition and immersion time.

The following examples are presented for illustration purposes only and are not intended to be construed as limiting the invention as otherwise described above.

Example 1

A two-step edging process comprised mechanical lapping by hand, followed by mechanical polishing with 10-μm alumina particles for a total of 1 minute.

Example 2

A two-step edging process comprised mechanical grinding with 800 grit diamond particles, followed by mechanical grinding with 3000 grit diamond particles.

Example 3

A three-step edging process comprised mechanical grinding with 800 grit diamond particles, followed mechanical grinding with 3000 grit diamond particles, followed by mechanical polishing with 10-μm alumina particles.

Example 4

A four-step edging process comprised mechanical grinding with 400 grit diamond particles, followed by mechanical grinding with 800 grit diamond particles, followed by mechanical grinding with 1500 grit diamond particles, followed by 3000 grit mechanical grinding for a total of 17 minutes.

Example 5

A five-step edging process comprised mechanical grinding with 400 grit diamond particles, followed by mechanical grinding with 800 grit diamond particles, followed by mechanical grinding with 1500 grit diamond particles, followed by 3000 grit mechanical grinding, followed by mechanical polishing with 10-μm alumina particles.

Example 6

A polishing process comprised a MRF process using a MPF having a viscosity of 44-45 centipoise and containing carbonyl iron particles and cerium oxide particles suspended in a liquid medium. Other process parameters included: MRF wheel speed at 259 rpm, electromagnet current setting at 18 amperes, ribbon height of 1.5 mm, and edge immersion depth of 0.5 mm to 0.75 mm. Material removal using the MRF was approximately 0.5 μm/side material removal.

Example 7

A polishing process comprised a MRF process using MPF having a viscosity of 44-45 centipoise and containing carbonyl iron particles and diamond particles suspended in a liquid medium. Other process parameters include: MRF wheel speed at 259 rpm, electromagnet current setting at 18 amperes, ribbon height of 1.5 mm, and edge immersion depth of 0.5 mm to 0.75 mm. Material removal using the MRF was approximately 0.5 μm/side material removal.

Example 8

A commercially-available ion-exchanged glass sheet was cut by laser separation. Each as cut glass sheet had a size of 60.75 mm×44.75. Each resulting glass sheet after mechanical grinding and prior to MRF had a size of 60 mm×44 mm. The edge strength of each glass sheet after cutting by laser separation was on average in a range from 600 MPa to 900 MPa. The glass sheets were subjected to an edging process according to Example 5. The edge strength of each glass sheet after edging (i.e., first edge strength) was on average in a range from 242 MPa to 299 MPa. After edging, the glass sheets were polished using MRF according to Example 6 for 1, 5, or 15 minutes. The edge strengths of the glass sheets after MRF (i.e., second edge strengths) are reported in Table 1 below. Edge strengths were measured by a horizontal 4-point bend. The results show that MRF improves the edge strengths of the glass sheets.

TABLE 1

| | Strength (MPa) | | |
|---|---|---|---|
| Reference No. | Laser separation, 5-step edging, MRF for 1 min | Laser separation, 5-step edging, MRF for 5 min | Laser separation, 5-step edging, MRF for 15 min |
| A1 | 258 | 285 | 727 |
| B1 | 253 | 276 | 731 |
| C1 | — | 294 | 1072 |
| D1 | — | 487 | 907 |
| E1 | — | 329 | — |
| Average | 255.5 | 334.2 | 859.25 |

Example 9

A commercially-available ion-exchanged glass sheet was cut to glass sheets by laser cutting. Each as cut glass sheet had a size of 60.75 mm×44.75. Each resulting glass sheet after mechanical grinding and prior to MRF had a size of 60 mm×44 mm. The edge strength of each glass sheet after laser cutting was on average in a range from 600 MPa to 900 MPa. The glass sheets were subjected to an edge process according to Example 4. After edging, the small glass sheets were polished using MRF according to Example 7. The edge strengths of the glass sheets after abrasive machining and after MRF are reported in Table 2 below. Edge strengths were measured by a horizontal 4-point bend. Again, the edge strengths improved after MRF for the glass sheets.

TABLE 2

| Reference No. | Strength (MPa) Laser separation, 4-step edging | Laser separation, edging, MRF for 6 min | Improvement |
|---|---|---|---|
| A2 | 289 | 994 | 244% |
| B2 | 310 | 754 | 143% |
| C2 | 281 | 178 | (37%) |
| D2 | 325 | 490 | 51% |
| E2 | 285 | 966 | 239% |
| Average | 298 | 801 | 128% |

Example 10

A commercially-available ion-exchanged glass sheet was cut by mechanical separation. The resulting glass sheets were subjected to an edging process according to Example 4. After edging, the glass sheets were polished using MRF according to Example 7. The edge strengths of the glass sheets after edging and after MRF are reported in Table 3 below. Edge strengths were measured by a horizontal 4-point bend. As in the previous examples, the edges strengths were improved after MRF.

TABLE 3

| Reference No. | Strength (MPa) Mechanical separation, 4-step edging | Mechanical separation, 4-step edging, MRF for 6 min | Improvement |
|---|---|---|---|
| A3 | 296 | 971 | 228% |
| B3 | 274 | 713 | 160% |
| C3 | 274 | 963 | 251% |
| D3 | 219 | 425 | 94% |
| E3 | 218 | 693 | 218% |
| Average | 256 | 753 | 190% |

Example 11

A commercially-available ion-exchanged glass sheet was cut by laser separation. The resulting glass sheets were subjected to an edging process according to Example 1. After the edging process, the glass sheets were polished using MRF according to Example 7. The edge strengths of the glass sheets after edging and after MRF are reported separately in Table 4 below. Edge strengths were measured by a horizontal 4-point bend.

TABLE 4

| Reference No. | Strength (MPa) Laser separation, two-step edging | Laser separation, two-step edging, 6-min MRF | Improvement |
|---|---|---|---|
| A4 | 148 | 815 | 451% |
| B4 | 157 | 944 | 501% |
| C4 | 181 | 994 | 449% |
| D4 | 172 | 973 | 466% |
| E4 | 187 | 950 | 408% |
| Average | 169 | 935 | 455% |

Example 12

A commercially-available ion-exchanged glass sheet was cut by laser separation. The resulting glass sheets were subjected to an edging process according to Example 3. After edging, the glass sheets were polished using MRF according to Example 7. The edge strengths of the glass sheets after edging and after MRF are reported separately in Table 5 below. Edge strengths were measured by a horizontal 4-point bend.

TABLE 5

| Reference No. | Strength (MPa) Laser separation, three-step edging | Laser separation, three-step edging, MRF for 6 min | Improvement |
|---|---|---|---|
| A5 | 227 | 301 | 33% |
| B5 | 254 | 612 | 141% |
| C5 | 150 | 321 | 114% |
| D5 | 266 | 229 | (14%) |
| E5 | 255 | 332 | 30% |
| Average | 230 | 359 | 61% |

Example 13

A commercially-available ion-exchanged glass sheet was cut by laser separation. The resulting glass sheets were subjected to an edging process according to Example 2. After edging process, the glass sheets were polished using MRF according to Example 7. The edge strengths of the glass sheets after edging and after MRF are reported separately in Table 6 below. Edge strengths were measured by a horizontal 4-point bend.

TABLE 6

| Reference No. | Strength (MPa) Laser separation, two-step edging | Laser separation, two-step edging, MRF for 6 min | Improvement |
|---|---|---|---|
| A6 | 249 | 315 | 27% |
| B6 | 252 | 140 | (44%) |
| C6 | 273 | 512 | 88% |
| D6 | 215 | 217 | 1% |
| E6 | 233 | 293 | 26% |
| Average | 244 | 295 | 19% |

Example 14

A commercially-available ion-exchanged glass sheet was cut by laser separation. After laser separation, the cut glass sheets were polished using MRF according to Example 7. The edge strengths of the glass sheets after laser separation and after MRF are reported separately in Table 7 below. Edge strengths were measured by horizontal 4-point bend.

TABLE 7

| Reference No. | Strength (MPa) Laser separation | Laser separation, MRF for 6 min | Improvement |
|---|---|---|---|
| A | 756 | 1120 | 48% |
| B | 669 | — | — |
| C | 963 | — | — |
| Average | 796 | — | — |

When a negative effect after MRF is observed, the likely explanation is as follows: MRF is very likely providing a positive effect or no effect after any prior mechanical edge process. The samples used to determine strength before MRF processing were destructively analyzed using 4-point bend. Those samples then represent the strength of subsequent samples before being processed with the MRF. It is very possible that strength variation before the MRF step within the same lot of samples, could result in a lower unmeasured strength before MRF, subsequently a lower strength after the MRF step.

Figure 3:
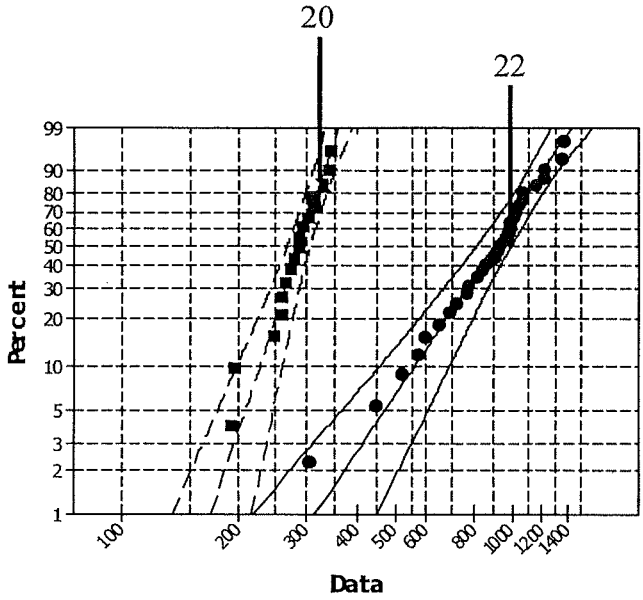
FIG. 3 is a graph comparing the edge strength of mechanically finished edges and MRF finished edges made according to exemplary methods.

MRF edges were produced as shown by data 22 in FIG. 3 to show the process optimization for high strength edges using MRF methods as described herein. The data is shown in megapascals (MPa). In FIG. 3, B10 equals 561 MPa. 10 of the 30 data points for the MRF edges made according to the exemplary MRF methods are greater than 1 gigapascal (GPa). The process included flare surface treatment to minimize surface flaw related breaks, skin coating for mechanical grinding, and soft MRF chuck contacts to minimize handling and finishing flaws. Data 20 in FIG. 3 demonstrates the best mechanical results as input coupled with Data 22 in FIG. 3 representing the best to-date MRF output results for edge strength. The exemplary MRF methods now produce a significant population of edge strengths equivalent to glass surface strengths.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of preparing an edge-strengthened article, comprising: polishing of an edge of a glass or glass ceramic article having a first edge strength using a magnetorheological fluid, wherein the magnetorheological fluid comprises an etching agent having a pH≤5 and after the polishing, the glass or glass ceramic article has a second edge strength and the second edge strength is greater than the first edge strength.

2. The method of claim 1, wherein polishing the article comprises a plurality of magnetorheological finishing steps.

3. The method of claim 1, further comprising providing the article prior to the polishing with an initial edge strength that is different from the first edge strength, and wherein a difference in the initial edge strength and the first edge strength is due at least in part to one of cutting the article, modifying a shape and/or texture of the edge of the article, and chemically-strengthening the article.

4. The method of claim 1, further comprising cutting the article prior to the polishing.

5. The method of claim 1, further comprising modifying a shape and/or texture of the edge of the article prior to the polishing.

6. The method of claim 1, further comprising subjecting the article to an ion-exchange process prior to or after the polishing.

7. The method of claim 1, wherein the polishing is preceded by cutting the edge of the article and modifying a shape and/or texture of the edge of the article after the cutting, the modifying comprising a plurality of process steps selected from mechanical grinding, and mechanical polishing.

8. The method of claim 1, wherein polishing the edge of the article comprises applying a magnetic field to the magnetorheological polishing fluid to stiffen the magnetorheological polishing fluid, contacting the edge with the stiffened magnetorheological polishing fluid, and affecting a relative motion between the edge and the stiffened magnetorheological polishing fluid.

9. The method of claim 1, wherein the etching agent comprises an acid.

10. The method of claim 1, wherein the etching agent is selected from the group consisting of hydrofluoric acid and sulfuric acid.

11. The method of claim 1, wherein the edge-strengthened article has an edge strength of from 600 MPa to 900 MPa.

12. The method of claim 1, wherein the edge is polished for 1 to 5 minutes.

13. The method of claim 1, wherein the edge-strengthened article has an edge strength greater than 1 GPa.

14. The method of claim 1, wherein the magnetorheological fluid comprises magnetizable particles having a particle size of from 1 micron to 150 microns.

15. The method of claim 1, wherein the glass or glass ceramic article comprises a glass sheet.

16. The method of claim 15, wherein the glass sheet is cut via a mechanical or laser process prior to polishing.

17. The method of claim 15, wherein, prior to polishing the glass sheet with a magnetorheological fluid, the glass sheet undergoes one or more of the following steps: lapping, mechanical polishing, or mechanical grinding.

18. A method of preparing an edge-strengthened article comprising contacting an edge of a glass or glass ceramic article with a magnetorheological fluid that comprises magnetizable particles, abrasive particles, and an etching agent having a pH≤5.

* * * * *